US005596785A

United States Patent [19]

Park

[11] Patent Number: 5,596,785

[45] Date of Patent: Jan. 28, 1997

[54] MULTI-UTILITY SHOE BRUSH SYSTEM

[76] Inventor: Hyun C. Park, 8445 Mandarin Ave., Rancho Cucamonga, Calif. 91730

[21] Appl. No.: 513,229

[22] Filed: Aug. 10, 1995

[51] Int. Cl.[6] ..... A47L 23/05

[52] U.S. Cl. ..... 15/114; 15/161; 15/201

[58] Field of Search ..... 15/105–107, 114, 15/159.1, 160, 161, 201, 202

[56] References Cited

U.S. PATENT DOCUMENTS

| | | | |
|---|---|---|---|
| 52,787 | 2/1866 | Gissinger | 15/107 |
| 378,784 | 2/1988 | Foster et al. . | |
| 668,993 | 2/1901 | Le Compte . | |
| 845,928 | 3/1907 | Brooks . | |
| 863,693 | 8/1907 | Bluthenthal . | |
| 898,998 | 9/1908 | Stubenrauch . | |
| 1,061,276 | 5/1913 | Ellis . | |
| 1,082,922 | 12/1913 | Bemis | 15/201 |
| 1,870,057 | 3/1931 | Levin . | |
| 2,190,277 | 4/1937 | Viragh . | |

FOREIGN PATENT DOCUMENTS

| | | | |
|---|---|---|---|
| 485006 | 3/1951 | Italy | 15/106 |
| 253922 | 4/1948 | Switzerland | 15/106 |
| 691385 | 5/1953 | United Kingdom | 15/106 |

*Primary Examiner*—David Scherbel
*Assistant Examiner*—Terrence R. Till
*Attorney, Agent, or Firm*—John K. Park; Law Offices of John K. Park & Associates

[57] ABSTRACT

A multi-utility shoe brush system (11) is provided which includes a main body (13) having a several sides meeting other adjacent sides to form angles greater than ninety degrees so a plurality of paste applicator brushes (17, 19, 21*b*), a soft buffing brush (45), hard soil-removing brush (21*a*, 53), and one or more polishing pads (23, 27). A handle (31) is attached to the main body (13) to increase the efficiency of the use of the multi-utility shoe brush system (11), and its cleanliness. Each of the brushes and polishing pads is recommended to be removably attached to the main body (13). A shoe horn (49) is attached at the free end of the handle (31) for an additional utility.

17 Claims, 6 Drawing Sheets

MULTI-UTILITY SHOE BRUSH SYSTEM

BACKGROUND

This invention relates to a multi-utility shoe brush system. When people need to clean and to polish several pairs of shoes, they often need several brushes of different sizes and stiffness, and several polishing pads to be effective. Moreover, because there are so many different colors of shoes and their matching shoe pastes, the cleaning and polishing requires several different brushes to be effective. Furthermore, when a person tries to use a single brush in applying more than one color of paste, the residue of the prior application mixes with the new application so that a uniform color application is difficult. Especially with today's highly distinguishably varying colors, finishes and delicate leather treatments on shoe exteriors, combined with the efficiency and convenience required in today's fast paced society, the shoe cleaning and polishing demand an improved multi-utility shoe brush system.

Prior art had attempted to arrange more than one brush and a polishing pad on a single device. However, even in these multi-purpose brush units illustrated in prior art, these units were limited to having one paste applicator brush, one soft buffing brush, one hard soil-removing brush, and one polishing pad. Therefore, having several brushes within a unit did not solve the problem of needing to have more than one pastor applicator brush within a unit.

For the foregoing reasons, there is a need for a multi-utility shoe-brush system which incorporates several paste applicator brushes, a soft buffing brush, a hard soil-removing brush, and one or more polishing pads within a single unit, so that a person may efficiently clean and polish shoes with one hand held unit. Moreover, there is also a need for a simple and comparatively inexpensive multi-utility shoe brush system in which the various polishing parts, brushes and polishing pads, are accessibly assembled in such positions that each of the polishing parts may be used separately and successively, and in the proper order.

SUMMARY

The present invention is directed to a multi-utility shoe brush system that can eliminate the need to carry several brushes and several polishing pads. The multi-utility shoe brush system is a single, hand held, device which integrates several brushes and several polishing pads to increase the efficiency, while separating each brush and each polishing pad so these brushes and pads will not interfere with the one being used. Moreover, each of the polishing parts is accessibly oriented so that each part may be used successively in the proper order.

One version of the multi-utility shoe brush system comprises a main body with five sides and two faces, and a cleaning system comprising one or more brushes and one or more polishing pads. Unlike a regular rectangular-shaped shoe brush with two faces and four sides, the main body has two faces and five sides. The main body is able to have five sides along with two faces because four of the five sides meet at angles greater than ninety degrees. That is, the first side and the second side forms a first angle greater than ninety degrees, the second side and the third side forms a second angle greater than ninety degrees, and the third side and the fourth side forms a third angle greater than ninety degrees.

In this version of the multi-utility shoe brush system, the cleaning system comprises one or more brushes and one or more polishing pads. The preferred combination of the brushes and the polishing pads in this version of the multi-utility shoe brush system is one polishing pad on the first side, one paste applicator brush on the second side, one paste applicator brush on the third side, one hard soil-removing brush on the fourth side, a handle attached to the fifth side, a soft buffing brush on the lower face, and a polishing pad on the upper face.

Another version of the multi-utility shoe brush system comprises a main body with six sides and two faces, and a cleaning system comprising one or more brushes and one or more polishing pads. Unlike a regular rectangular-shaped shoe brush and unlike the first version described above, the main body has two faces and six sides. The main body is able to have six sides along with two faces because five of the six sides meet at angles greater than ninety degrees, creating the fifth side and the sixth side. That is, the first side and the second side forms a first angle greater than ninety degrees, the second side and the third side forms a second angle greater than ninety degrees, the third side and the fourth side forms a third angle greater than ninety degrees, and the fourth side and the fifth side forms a fourth angle greater than ninety degrees.

In this second version of the multi-utility shoe brush system, the cleaning system comprises one or more brushes and one or more polishing pads. The preferred combination of the brushes and the polishing pads in this version of the multi-utility shoe brush system is one polishing pad on the first side, one paste applicator brush on the second side, one paste applicator brush on the third side, one paste applicator brush on the fourth side, one hard soil-removing brush on the fifth side, a handle attached to the sixth side, a soft buffing brush on the lower face, and a polishing pad on the upper face.

Because polishing pads are generally made of soft material, such as cloth or sponge, it is preferable to have these polishing pads removably and replaceably attached to the main body. This is more true with the polishing pad attached to the upper face, because this polishing pad will be used often. Similarly, it is preferable to have the brushes removably attached to the main body as well.

One of the advantages in using this multi-utility shoe brush system is that although there are several brushes and pads which are integrated onto this single unit, none of the other brushes or the pads will interfere with the other brushes or pads when the Multi-utility shoe brush system is being used. This is because there is only one brush or one pad on each side or face, and each side is sufficiently separated from all other sides and faces.

Another advantage in using this multi-utility shoe brush system is that each of the several paste applicator brushes in the system can have different stiffness of the brush bristles so that the best brush for a job can be chosen. That is, the user may choose different stiffness and softness in the paste applicator brush bristles in order to adapt to each specific application, according to the difference in the shoe exterior finishes and textures. Moreover, because there are several paste applicator brushes, each paste applicator brush can be used only for a particular color of paste; such as one brush for black paste, one brush for brown paste, and one brush for neutral paste.

Another advantage in using this multi-utility shoe brush system is that because of a long handle attached to the main body, the user does not have to handle the main body, reducing the risk of the paste rubbed on the user's hand. Moreover, the long handle makes the multi-utility shoe brush system easy to use and handle, increasing the efficiency.

Another advantage in using this multi-utility shoe brush system is that because the polishing pad on the upper face is removably attached to the main body, this more often used polishing pad can be easily replaced. Moreover, with the polishing pad removed, a different large brush, such as another soft buffing brush, can be removably attached to the upper face if needed. Furthermore, as an alternate, a hair brush or even a cloth lint-removing brush may be removably attached to the upper face.

DRAWINGS

These and other features, aspects, and advantages of the present invention will become better understood with regard to the following description, appended claims, and accompanying drawings where:

DESCRIPTION

With reference to the figures, a multi-utility shoe brush system 11 according to the present invention comprises a main body 13 and a cleaning system 15 wherein the cleaning system 15 comprises of at least one of a plurality of paste applicator brushes.

Figure 1:
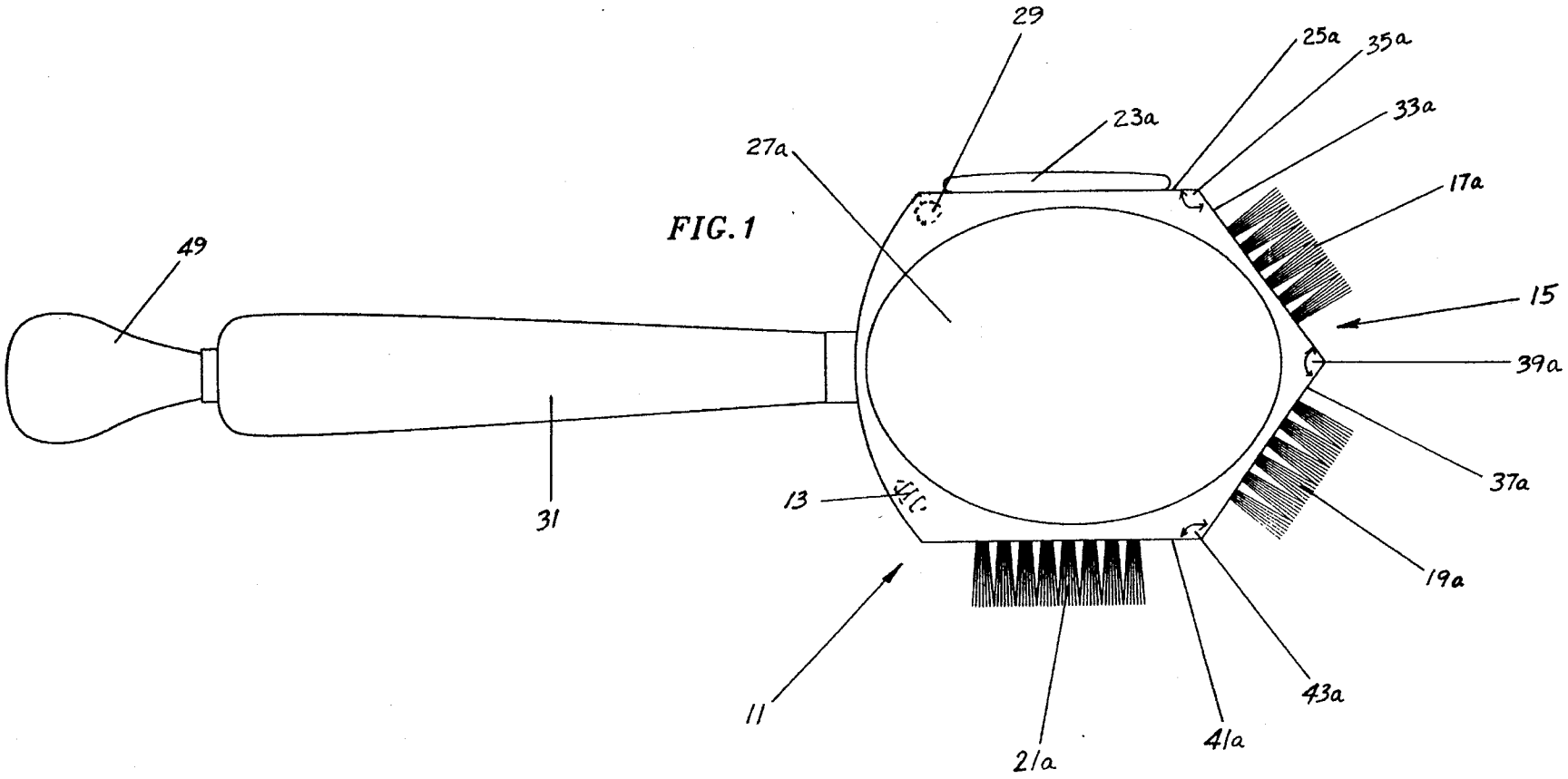
FIG. 1 is a top plane view of the first embodiment of the present invention.

FIG. 1 shows one embodiment of the multi-utility shoe brush system 11 comprising the main body 13 and the cleaning system 15 comprising a first brush 17*a*, a second brush 19*a*, a third brush 21*a*, a first polishing pad 23*a* on a first side 25*a*, a second polishing pad 27*a* on an upper face 29, and a handle 31. An advantage of the multi-utility shoe brush system 11 can easily be seen that, although there are three brushes 17*a* 19*a* 21*a* and two polishing pads 23*a* 27*a*, the use of any one of brushes or pads will not interfere with unused brushes or pads because of the angles separating each of the sides.

It is necessary, in order to have as many brushes or pads as shown in FIG. 1, that the angles formed when each of the four adjacent sides 25*a* 33*a* 37*a* 41*a* meet be greater than ninety degrees. That is the first side 25*a* and the second side 33*a* are adjacent sides to form a first angle 35*a* greater than ninety degrees, the second side 33*a* and the third side 37*a* are adjacent sides to form a second angle 39*a* greater than ninety degrees, and the third side 37*a* and the fourth side 41*a* are adjacent sides to form a third angle 43*a* greater than ninety degrees. The preferred embodiment is that the first angle 35*a* is between about 120 degrees and about 130 degrees, and the third angle 43*a* is between about 120 degrees and about 130 degrees. The most preferred embodiment is that the first angle 35*a* is about 120 degrees, and the third angle 43*a* is about 120 degree.

Figure 3:
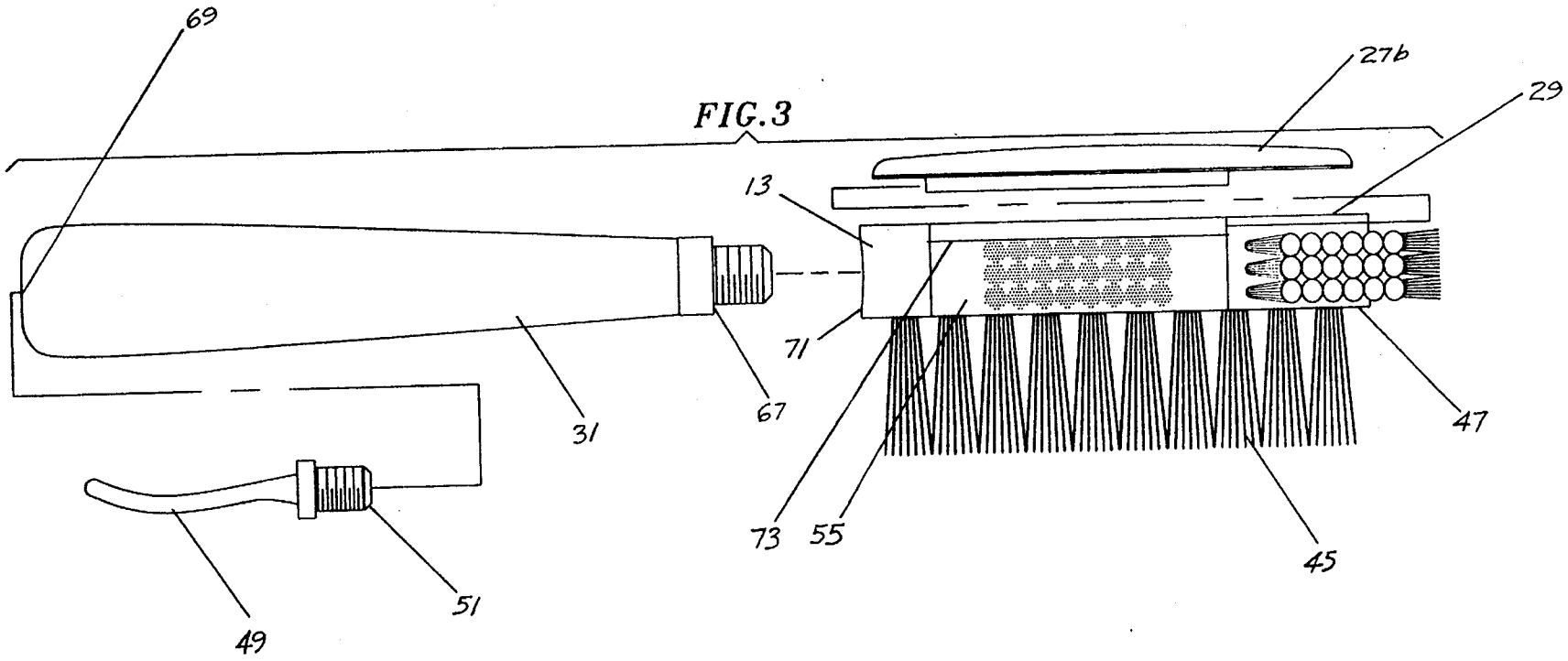
FIG. 3 is a front view of the second embodiment of the present invention with the second polishing pad exploded to show its removability, with the handle exploded to show its removability, and the shoe horn exploded to show its removability.

The preferred combination of brushes is that the first brush 17*a* to be a paste applicator brush, the second brush 19*a* to be a paste applicator brush of different softness, the third brush 21*a* to be a hard soil-removing brush of the most stiffness, the first polishing pad 23*a* to be a soft polishing pad, the second polishing pad 27*a* on the upper face to be made out of a different softness material, and a soft buffing brush 45 on a lower face 47. The soft buffing brush 45 on the lower face 47 is not shown in FIG. 1, but is shown in FIG. 3.

FIG. 1 also shows a shoe-horn 49 with a locking end 51 conveniently attached to an end of the handle 31.

Figure 2:
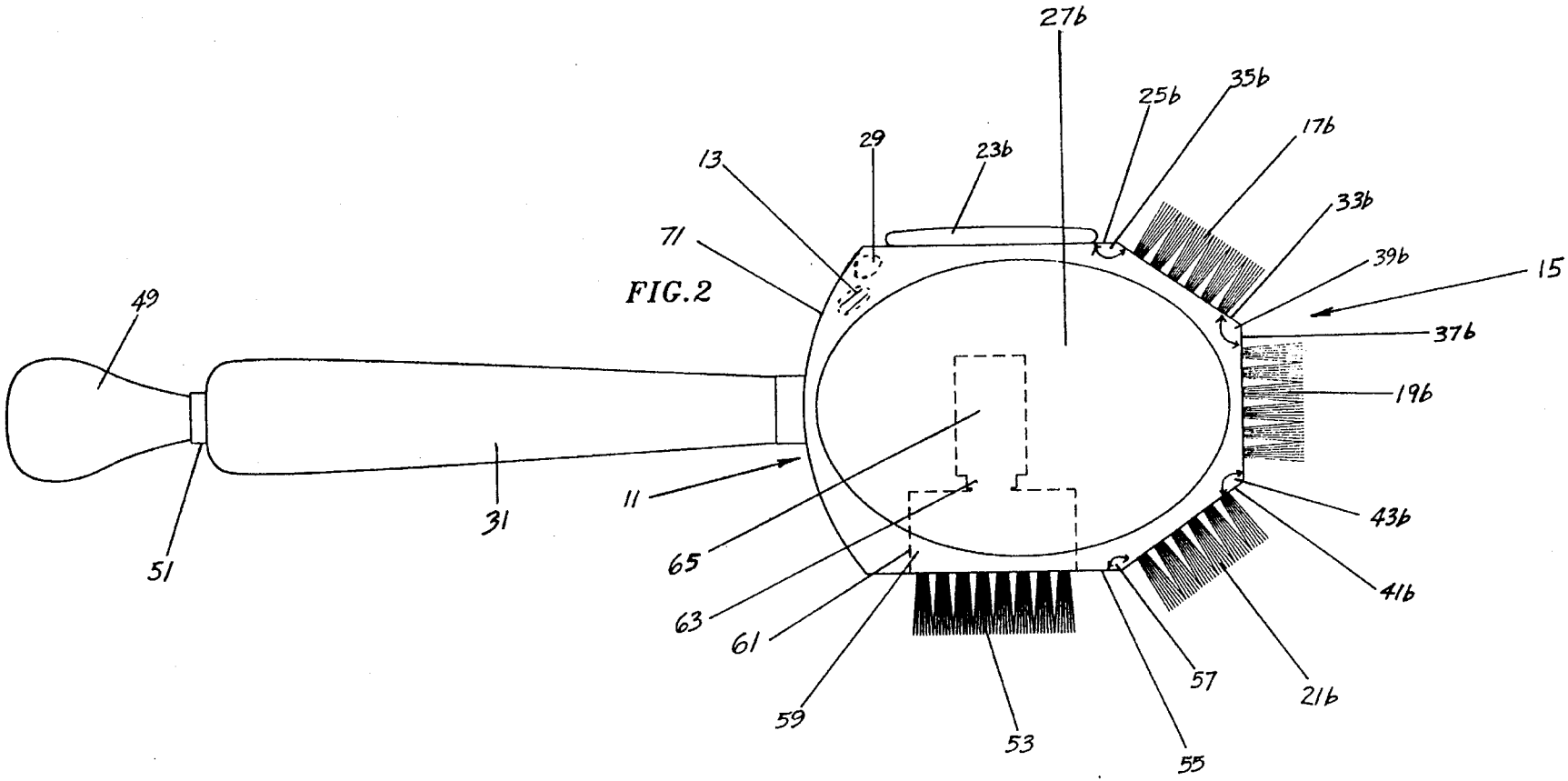
FIG. 2 is a top plane view of the second embodiment of the present invention.

FIG. 2 shows another embodiment of the multi-utility shoe brush system 11 comprising the main body 13 and the cleaning system 15 comprising a first brush 17*b*, a second brush 19*b*, a third brush 21*b*, a fourth brush 53, a first polishing pad 23*b* on the first side 25*b*, a second polishing pad 27*b* on the upper face 29, and a handle 31. An advantage of this embodiment of the multi-utility shoe brush system 11 can easily be seen that, although there are four brushes 17*b* 19*b* 21*b* 53 and two polishing pads 23*b* 27*b*, the use of a brush or a pad will not interfere with unused brushes or pads because of the angles separating each of the sides.

It is necessary, in order to have as many brushes or pads as shown in FIG. 2, that the angles formed when each of the sides meet be greater than ninety degrees. That is the first side 25*b* and the second side 33*b* are adjacent sides to form a first angle 35*b* greater than ninety degrees, the second side 33*b* and the third side 37*b* are adjacent sides to form a second angle 39*b* greater than ninety degrees, the third side 37*b* and the fourth side 41*b* are adjacent sides to form a third angle 43*b* greater than ninety degrees, and the fourth side 41*b* and the fifth side 55 are adjacent sides to form a third angle 57 greater than ninety degrees. The preferred embodiment is that the first angle 35*b* is between about 130 degrees and about 160 degrees, and the fourth angle 57 is between about 130 degrees and about 160 degrees. The most preferred embodiment is that the first angle 35*b* is about 150 degrees, the second angle 39*b* is about 120 degrees, the third angle 43*b* is about 120 degrees, and the fourth angle 57 is about 150 degrees.

The preferred combination of brushes in this embodiment of the invention is that the first brush 17*b* to be a paste applicator brush, the second brush 19*b* to be a paste applicator brush of different softness, the third brush 21*b* to be a paste applicator brush of different softness from the first brush 17*b* and the second brush 19*b*, the fourth brush 53 to be a hard soil-removing brush of the most stiffness, the first polishing pad 23*b* to be made of soft material, such as soft sponge, the second polishing pad 27*b* on the upper face 29 to be made of different softness material, and a soft buffing brush 45 on a lower face 47. The soft buffing brush 45 on the lower face 47 is not shown in FIG. 1, but is shown in FIG. 3.

FIG. 2 also shows a shoe-horn 49 with a locking end 51 conveniently attached to an end of the handle 31.

FIG. 2 also shows the outline of a rectangular cavity 59, formed by a plurality of walls 61 which are cut into the main body 13, so that the fourth brush 53 may slide in and out of the main body 13. Also shown in FIG. 2 is the outline of a locking mechanism 63 which allows the fourth brush 53 to be locked in the main body 13 and the out of the main body 13. FIG. 2 also shows the outline of a spring mechanism 65. The locking mechanism 63 and the spring mechanism 65 are better shown in the FIG. 2A and FIG. 2B.

The combination of the rectangular cavity 59 and the locking mechanism 63 can conveniently hide the fourth brush 53 away when the fourth brush 53 is not in use. This concept of retractively storing a brush or a pad may be utilized with any of the brushes or pads of this invention.

Figure 2A:
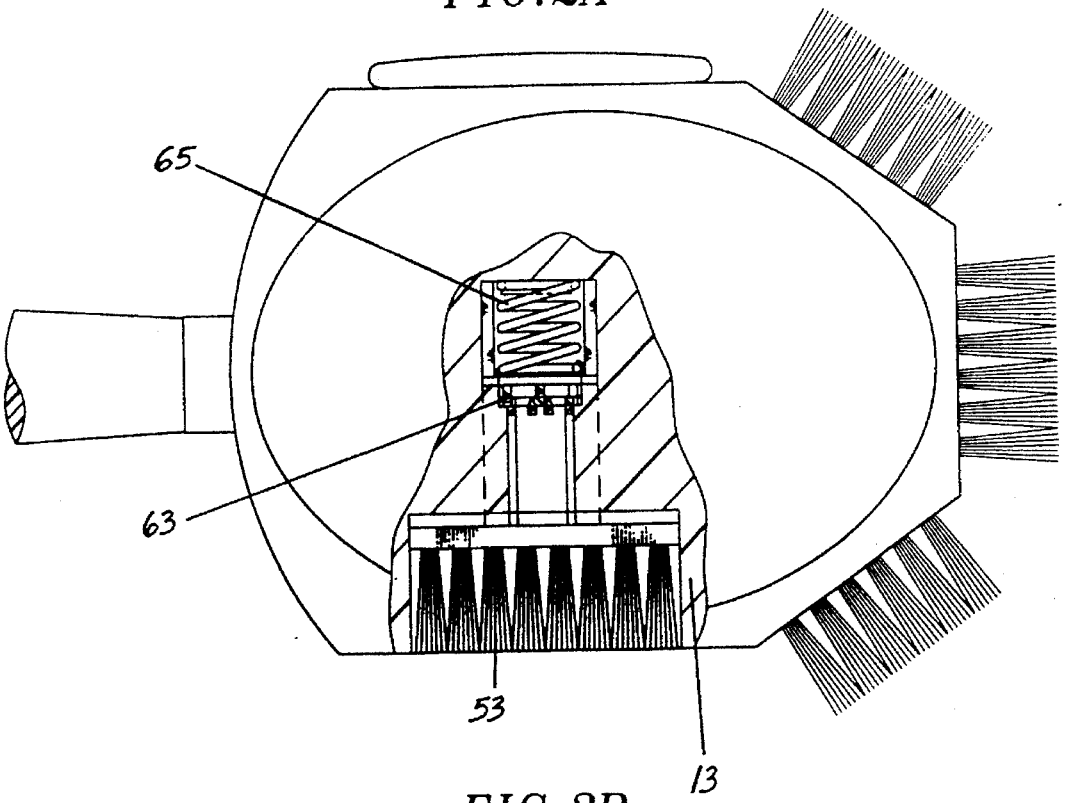
FIG. 2A is a partially broken away section of the top plane view of the second embodiment of the present invention exposing the retractable hard soil brush retracted into the main body, with a spring mechanism depressed.
Figure 2B:
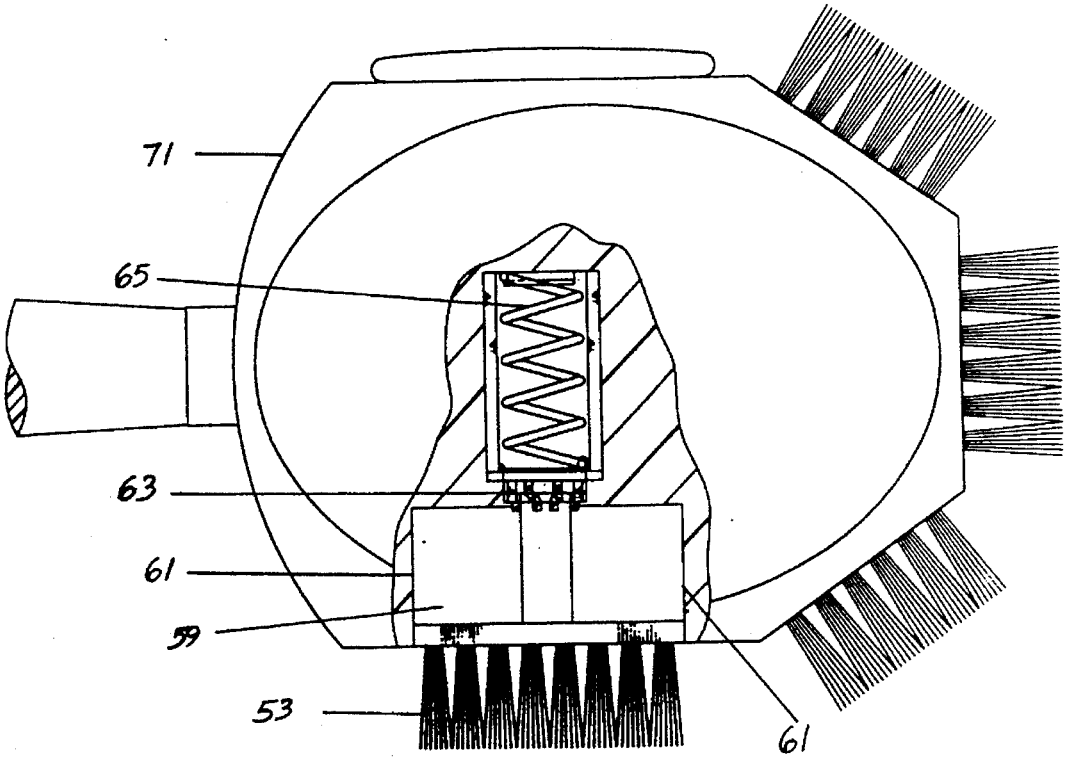
FIG. 2B is a partially broken away section of the top plane view of the second embodiment of the present invention exposing the retractable hard soil brush extended out of the main body, with the spring mechanism released.

FIG. 2A and FIG. 2B show the general working of the locking mechanism 63. FIG. 2A illustrates the fourth brush 53 locked away inside the main body 13 with the spring mechanism 65 depressed. FIG. 2B illustrates the fourth brush 53 released outside the main body 13 with the spring mechanism 65 also released.

The inventor does not fully understand the mechanical details of the locking mechanism 63, but the locking mechanism 63 shown represents a common plunger type locking device which is commonly used at an end of ball-point pens to store the ink cartridge away when not in use. This illustration of the locking mechanism 63 is to illustrate one of the means for locking the fourth brush 53 inside the main body 13 and outside the main body 13. This illustration does not limit the use of any other means of locking the brush or the pad inside and outside the main body 13 such as use of pins, screws, nuts and bolts, a spring and a release, or other mechanical devices.

FIG. 3 shows the second embodiment of the present invention shown in FIG. 2 with the second polishing pad **27*b* exploded to show its removability, with the handle 31 exploded to show its removability, and the shoe horn exploded to show its removability. As illustrated in FIG. 3, the handle 31 has a first end 67 and a second end 69 wherein the first end 67 removably attaches to a sixth side 71 of the main body 13. The second end 69 removably accepts the locking end 51 of the shoe horn 49. FIG. 3 also shows the soft buffing brush 45 attached on the lower face 47 of the main body 13**.

FIG. 3 shows the second polishing pad **27*b* slidably attaching to the upper face 29 of the main body 13 by the use of a groove 73 on the first side 25*b* and the fifth side 55. One advantage of the removability of the second polishing pad 27*b* is that it can be replaced after an extended use. The softness of the second polishing pad 27*b* would require periodic replacements to maintain the multi-utility shoe brush system 11 at its best efficiency. Moreover, if the multi-utility shoe brush system 11 requires another buffing brush 45 or anything else, the second polishing pad 27*b*** can be removed and replaced with another brush or pad according to the user's specific needs.

FIG. 3 illustrates the most preferred means to removably attach the second polishing pad **27*b*, the handle 31, and the shoe horn 49. This illustration, however, does not limit the use of any other means of removably attaching any of the brushes 17*b* 19*b* 21*b* 45 53, polishing pads 23*b* 27*b*, handle 31, or shoe horn 49 to the main body 13 or to the handle 31**. Alternate means would be the use of pins, screws, nuts and bolts, or other mechanical devices.

Figure 4:
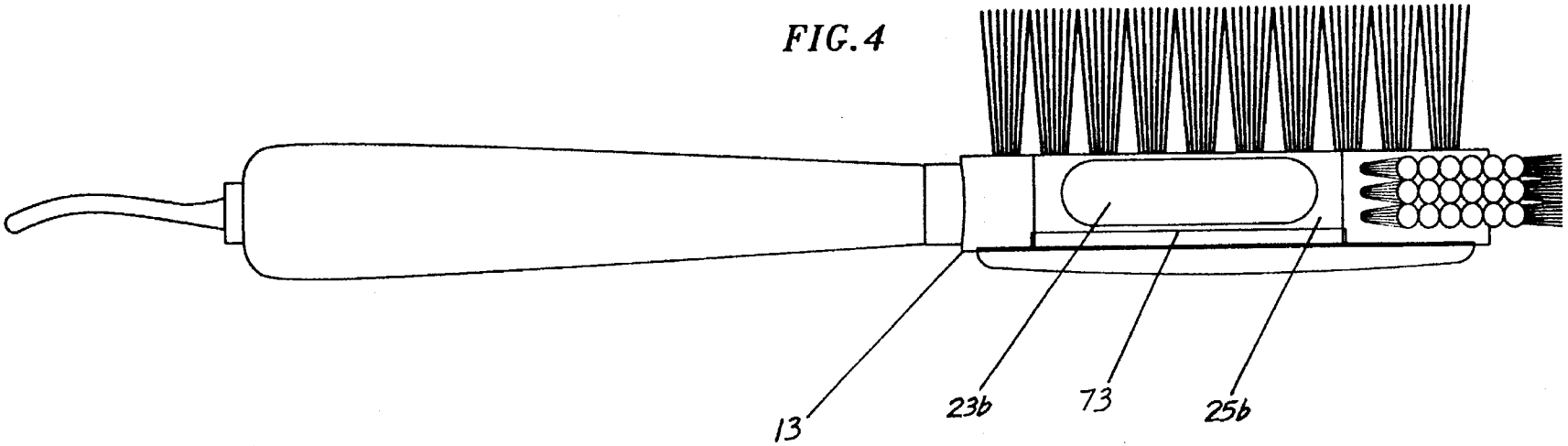
FIG. 4 is a rear view of the second embodiment of the present invention that shows a polishing pad on the side of the main body.

FIG. 4 shows the first polishing pad **23*b* mounted on the first side 25*b* of the main body 13. The removability of the first polishing pad 23*b*** is also preferred and the removability can be obtained by the use of snap-on pressure fitting device, screws, nails, pins, other mechanical devices, or bonding.

Figure 5:
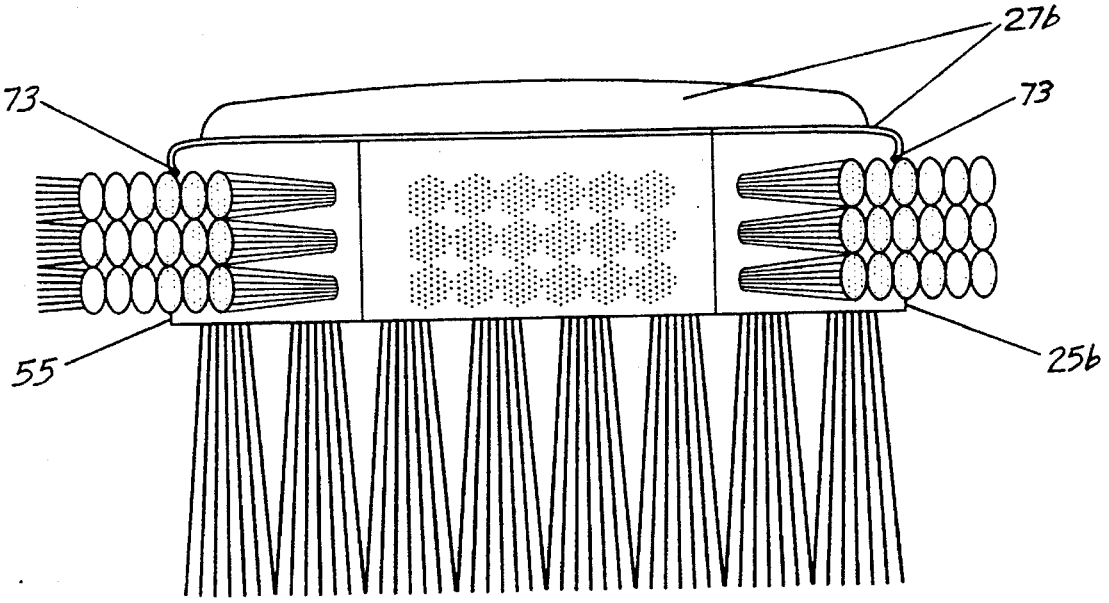
FIG. 5 is a side view of the second embodiment of the present invention.

FIG. 5 shows the second polishing pad **27*b* tightly fitting over the grooves 73 cut into the first side 25*b* and the fifth side 55 of the main body which can also be seen in FIG. 3. Moreover, the preferred embodiment will have each individual brushes removably attached to the main body 13**. Such removably attaching means could be the use of snap-on pressure fitting device, screws, nails, pins, other mechanical devices, or bonding.

Although the present invention has been described in considerable detail with reference to certain preferred versions thereof, other versions are possible. For example, each of the brushes can be replaced with a polishing pad of different softness and skin textures, a hair brush or a cloth lint-removing brush. For another example, the hard soil-removing brush can be replaced with a several metal spikes. For another example, a cover (not shown) may be used to enclose the main body 13 and the cleaning system 15 to protect the multi-utility shoe brush system 11.

Therefore, the spirit and scope of the appended claims should not be limited to the description of the preferred embodiment or the preferred versions contained therein.

What I claim is:

1. A multi-utility shoe brush system comprising:

a) a main body comprising an upper face, a lower face, and a plurality of sides, wherein the plurality of sides comprises a first side, a second side, a third side, a fourth side, and a fifth side; the first side and the second side are adjacent sides to form a first angle greater than ninety degrees, the second side and the third side are adjacent sides to form a second angle greater than ninety degrees, and the third side and the fourth side are adjacent sides to form a third angle greater than ninety degrees: and b) a cleaning system comprising a first brush attached the second side, a second brush attached to the third side, a buffing brush on the lower face, and a first polishing pad attached to the first side.

2. The multi-utility shoe brush system of claim 1 wherein the cleaning system further comprises a second polishing pad removably attached to the upper face.

3. The multi-utility shoe brush system of claim 2 wherein the shoe brush system further comprises a handle attached to one of the plurality of sides.

4. The multi-utility shoe brush system of claim 2 wherein the first angle is between about 120 degrees and about 130 degrees, and the third angle is between about 120 degrees and about 130 degrees.

5. A multi-utility shoe brush system comprising:

a) a main body comprising an upper face, a lower face, and a plurality of sides, wherein the plurality of sides comprises a first side, a second side, a third side, a fourth side, a fifth side, and a sixth side; the first side and the second side are adjacent sides to form a first angle greater than ninety degrees, the second side and the third side are adjacent sides to form a second angle greater than ninety degrees, the third side and the fourth side are adjacent sides to form a third angle greater than ninety degrees, and the fourth side and the fifth side are adjacent sides to form a fourth angle greater than ninety degrees; and b) a cleaning system comprising a first brush attached to the second side, a second brush attached to the third side, and a third brush attached to the fourth side.

6. The multi-utility shoe brush system of claim 5 wherein one of the first brush, the second brush, and the third brush has different stiffness from the other two brushes.

7. The multi-utility shoe brush system of claim 5 wherein each of the first brush, the second brush, and the third brush has different stiffness.

8. The multi-utility shoe brush system of claim 5 wherein the cleaning system further comprises a buffing brush on the lower face.

9. The multi-utility shoe brush system of claim 8 wherein the first angle is between about 130 degrees and about 160 degrees, and the fourth angle is between about 130 degrees and about 160 degrees.

10. The multi-utility shoe brush system of claim 9 wherein the first angle is about 150 degrees, the second angle is about 120 degrees, the third angle is about 120 degrees, and the fourth angle is about 150 degrees.

11. The multi-utility shoe brush system of claim 10 wherein the cleaning system further comprises a first polishing pad attached to the first side, and a second polishing pad attached to the upper face.

12. The multi-utility shoe brush system of claim 11 wherein the cleaning system further comprises a means for removably attaching the second polishing pad to the upper face.

13. The multi-utility shoe brush system of claim 12 wherein the cleaning system further comprises a fourth brush attached to the fifth side, wherein the fourth brush is a hard-bristled brush.

14. The multi-utility shoe brush system of claim 13 wherein the shoe brush system further comprises a handle with a first end and a second end, the first end attached to the sixth side.

15. The multi-utility shoe brush system of claim 14 wherein the shoe brush system further comprises a shoe horn attached to the second end of the handle.

16. The multi-utility shoe brush system of claim 15 wherein the cleaning system further comprises a plurality of walls wherein the plurality of walls forming a rectangular cavity into the fifth side, a means for slidably attaching the fourth brush within the rectangular cavity, and a means for locking the hard-bristled brush inside the body and outside the main body.

17. A multi-utility shoe brush system comprising:

a) a main body comprising an upper face, a lower face, and a plurality of sides, wherein the plurality of sides comprises a first side, a second side, a third side, a fourth side, a fifth side, and a sixth side; the first side and the second side are adjacent sides to form a first angle greater than ninety degrees, the second side and the third side are adjacent sides to form a second angle greater than ninety degrees, the third side and the fourth side are adjacent sides to form a third angle greater than ninety degrees, and the fourth side and the fifth side are adjacent sides to form a fourth angle greater than ninety degrees;

b) a cleaning system comprising a first brush attached to the second side, a second brush attached to the third side, and a third brush attached to the fourth side, wherein each of the first brush, the second brush, and the third brush has different brush stiffness; the cleaning system further comprises a buffing brush on the lower face, the buffing brush having a different brush stiffness from the first brush, the second brush, and the third brush; the cleaning system further comprises a first polishing pad attached to the first side, a second polishing pad attached to the upper face, and a means for removably attaching the second polishing pad to the upper face; the cleaning system further comprises a fourth brush attached to the fifth side, the fifth side having a rectangular cavity formed by a plurality of walls extending from the fifth side into the main body, a means for slidably attaching the fourth brush within the rectangular cavity, and a means for locking the fourth brush inside the body and outside the main body;

c) a handle with a first end and a second end wherein the second is attached to the sixth side; and d) a shoe horn attached to the second end of the handle.

* * * * *